US008947015B1

(12) United States Patent
Xiong

(10) Patent No.: US 8,947,015 B1
(45) Date of Patent: Feb. 3, 2015

(54) INDIRECT LINE VOLTAGE CONDUCTION ANGLE SENSING FOR A CHOPPER DIMMED BALLAST

(75) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 291 days.

(21) Appl. No.: 13/483,531

(22) Filed: May 30, 2012

Related U.S. Application Data

(60) Provisional application No. 61/576,642, filed on Dec. 16, 2011.

(51) Int. Cl.
*H05B 37/02* (2006.01)

(52) U.S. Cl.
USPC ..... 315/307; 315/224; 315/274

(58) Field of Classification Search
USPC ..... 315/219, 224, 247, 274, 276, 291, 307, 315/308
See application file for complete search history.

(56) References Cited

U.S. PATENT DOCUMENTS

| | | | | |
|---|---|---|---|---|
| 5,396,155 | A | 3/1995 | Bezdon et al. | |
| 5,539,281 | A | 7/1996 | Shackle et al. | |
| 5,559,395 | A | 9/1996 | Venkitasubrahmanian et al. | |
| 5,604,411 | A | 2/1997 | Venkitasubrahmanian et al. | |
| 5,801,492 | A | 9/1998 | Bobel | |
| 5,814,950 | A | 9/1998 | Carson et al. | |
| 6,172,466 | B1 | 1/2001 | Ki et al. | |
| 6,175,195 | B1 | 1/2001 | Janczak et al. | |
| 6,229,271 | B1 | 5/2001 | Liu | |
| 6,407,511 | B1 | 6/2002 | Yang et al. | |
| 6,448,713 | B1 | 9/2002 | Farkas et al. | |
| 8,022,634 | B2 * | 9/2011 | Greenfeld | 315/192 |
| 8,552,662 | B2 * | 10/2013 | Sun et al. | 315/294 |
| 2008/0018261 | A1 * | 1/2008 | Kastner | 315/192 |
| 2008/0309244 | A1 * | 12/2008 | Hsu | 315/219 |
| 2010/0327761 | A1 * | 12/2010 | Jin | 315/219 |
| 2011/0140620 | A1 * | 6/2011 | Lin et al. | 315/224 |
| 2012/0319621 | A1 * | 12/2012 | Sutardja et al. | 315/307 |

* cited by examiner

*Primary Examiner* — Tung X Le
(74) *Attorney, Agent, or Firm* — Waddey Patterson; Mark J. Patterson

(57) ABSTRACT

A ballast includes a rectifier, DC to DC converter, a dimming sensor, and a light source driver circuit. The rectifier provides rectified power from an AC power source modified by a chopper dimmer. The converter includes a boost inductor having a primary winding and a detection winding. The converter receives the rectified power from the rectifier and provides a DC power rail. The dimming sensor monitors a voltage of the detection winding of the boost inductor and provides a dimming signal as a function of the monitored voltage. The light source driver circuit receives the dimming signal, receives the DC power rail, and provides power from the DC power rail to the light source as a function of the dimming signal. An amount of power provided to the light source by the light source driver circuit corresponds to a dimming level indicated by the dimming signal.

14 Claims, 5 Drawing Sheets

Lighting circuit is dimming 25%

INDIRECT LINE VOLTAGE CONDUCTION ANGLE SENSING FOR A CHOPPER DIMMED BALLAST

CROSS-REFERENCES TO RELATED APPLICATIONS

This application claims benefit of the following patent application which is hereby incorporated by reference: U.S. Provisional Patent Application No. 61/576,642, filed Dec. 16, 2011, entitled "Indirect Line Voltage Conduction Angle Sensing Method for Triac Dimming (Phase Control Dimming) Ballast."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to ballasts compatible with chopper dimmers (e.g., TRIAC based dimmers). More particularly, the invention relates to methods and circuits for accurately detecting a conduction phase angle or OFF time introduced by a chopper dimmer.

Referring to FIG. 1, many residential and commercial lighting systems use chopper dimmers to modify power from an alternating current (AC) power source (e.g., 115V 60 Hz power line) to achieve dimmed operation of a light source. The chopper dimmer 110 operates with a phase conduction angle or OFF time to periodically block power from the AC power source 102 from reaching the ballast 104 as a function of a dimming level set by a user of the chopper dimmer 110. The chopper dimmer 110 may be a TRIAC dimmer, a DIAC dimmer, an insulated gate bipolar transistor (IGBT), or any other type chopper dimmer.

Referring to FIG. 2, the ballast 104 thus receives the line voltage 202 (i.e., the 115 VAC 60 Hz voltage from the AC power source 102) modified by an OFF time 204 or phase conduction angle equal to the dimming level. In the example shown in FIG. 2, the dimming level is 25% such that the chopper dimmer 110 blocks the line voltage 202 from the ballast 104 for 25% of the half period following each zero crossing of the line voltage 202. The chopper dimmer 110 varies the dimming level as a function of input from the user. The ballast 104 provides power to the light source 112 (i.e., lamps 106 and 108) as a function of the received voltage from the chopper dimmer 110. During the ON time 206 of the chopper dimmer 110, the modified line voltage 120 matches the line voltage 202.

Chopper dimmers are compatible with incandescent light sources, but for light sources that require ballasts (i.e., driver circuits) such as fluorescent lamps, high intensity discharge lamps, and solid state light-emitting devices (e.g., LED's and OLED's), the ballast must detect the OFF time or conduction angle and dim the light as a function of the detected OFF time. If the ballast 104 does not accurately detect the OFF time or conduction angle, then the ballast 104 will not accurately dim the light source 112.

Referring to FIG. 3, a prior art conduction angle sensing circuit 306 of the ballast 104 is shown. An electromagnetic filter 302 receives the modified line voltage 120 from the chopper dimmer 110, and provides it to a rectifier 304 of the ballast 104. The rectifier 304 provides a direct current (DC) voltage to a DC to DC converter of the ballast. The conduction angle sensing circuit 306 monitors the DC voltage output by the rectifier 304 to determine the conduction angle. The conduction angle sensing circuit 306 is a high impendence circuit. Due to its relatively high capacitance and resistance, the conduction angle sensing circuit 306 is not fast enough to sense relatively small OFF times associated with low dimming levels (e.g., 10%), particularly at low load values of the rectifier 304.

BRIEF SUMMARY OF THE INVENTION

In one aspect of the invention, a ballast is operable to provide power to a light source from an AC power source modified by a chopper dimmer. The ballast includes a rectifier, DC to DC converter, a dimming sensor, and a light source driver circuit. The rectifier connects to the AC power source, receives AC power from AC power source, and provides rectified power. The DC to DC converter includes a boost inductor having a primary winding and a detection winding. The DC to DC converter receives the rectified power from the rectifier and provides a DC power rail. The dimming sensor monitors a voltage of the detection winding of the boost inductor of the DC to DC converter and provides a dimming signal as a function of the monitored voltage. The light source driver receives the dimming signal from the dimming sensor, receives the DC power rail from the DC to DC converter, and provides power from the DC power rail to the light source as a function of the dimming signal. An amount of power provided to the light source from the DC power rail by the light source driver circuit corresponds to a dimming level indicated by the dimming signal.

In another aspect of the invention, a light fixture receives power from AC power source modified by chopper dimmer and provide light. The light fixture includes a light source, a ballast, and a housing. The light source provides light in response to receiving power. The ballast provides power to the light source from the AC power source modified by the chopper dimmer. The ballast includes a rectifier, a DC to DC converter, it dimming sensor, and a light source driver circuit. The rectifier connects to the AC power source, receives AC power from the AC power source, and provides rectified power. The DC to DC converter includes a boost inductor having a primary winding and a detection winding. The DC to DC converter receives the rectified power from the rectifier and provides a DC power rail. The dimming sensor monitors the voltage of the detection winding of the boost inductor of the DC to DC converter and provides a dimming signal as a function of the monitored voltage. The light source driver circuit receives the dimming signal from the dimming sensor, receives the DC power rail from the DC to DC converter, and provides power from the DC power rail to the light source as a function of the dimming signal. An amount of power provided to the light source from the DC power rail by the light source driver circuit corresponds to a dimming level indicated by the dimming signal. The housing is connected to the light source and the ballast.

Another aspect of the invention, a method of providing power to a light source from an AC power source via a ballast, wherein the power from AC power source is modified by chopper dimmer, begins with rectifying the power from an AC power source via a rectifier of the ballast. A DC to DC converter of the ballast receives the rectified power from the rectifier. The DC to DC converter provides a DC power rail from the rectified power. The voltage of a detection winding of the boost inductor of the DC to DC converter of the ballast is monitored via a dimming sensor of the ballast. The dimming sensor provides a dimming signal to a light source driver circuit as a function of the monitored voltage of the detection winding. The light source driver circuit provides power from the DC power rail to the light source as a function of the dimming signal. An amount of power provided to the light source from the DC power rail by the light source driver circuit corresponds to a dimming level indicated by the dimming signal.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As used herein, "ballast" refers to any circuit for providing power from a power source to a light source. Additionally, "light source" refers to one or more light emitting devices such as fluorescent lamps, high intensity discharge lamps, incandescent bulbs, and solid state light-emitting elements such as LEDs, organic light emitting diodes, and plasmaloids.

Figure 1:
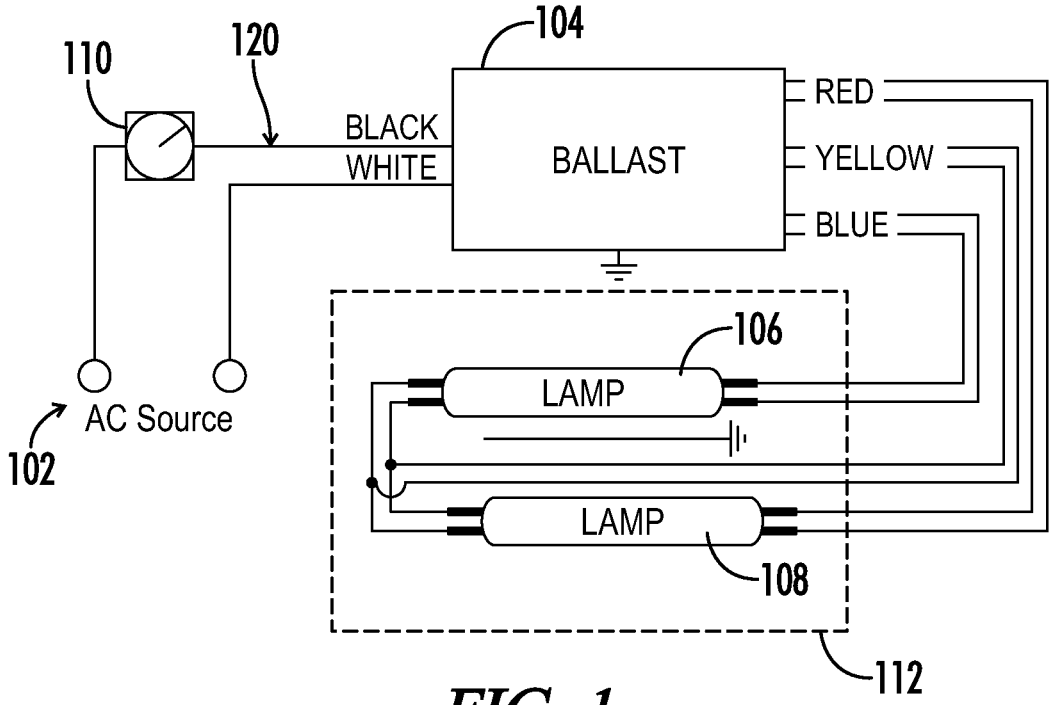
FIG. 1 (PRIOR ART)
FIG. 1 is a block diagram of a dimmed light source known in the prior art.
Figure 2:
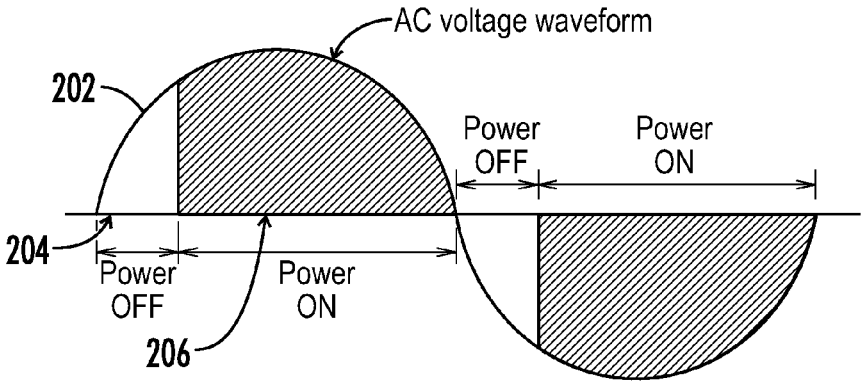
FIG. 2 (PRIOR ART)
FIG. 2 is a graph of a chopper dimmed AC line voltage over time as known in the prior art.
Figure 3:
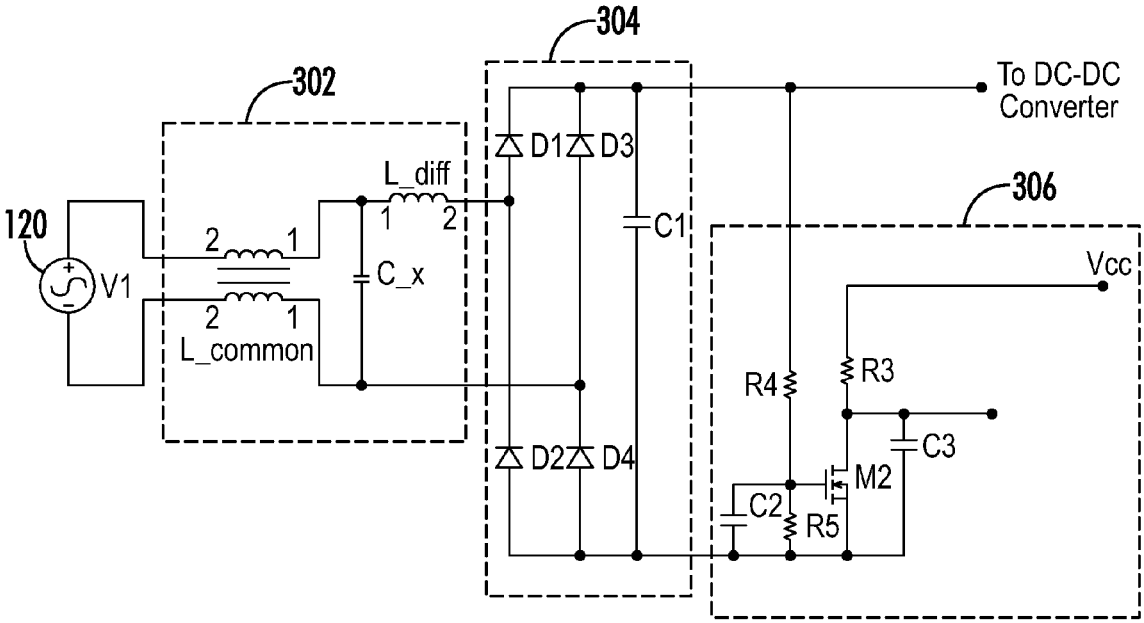
FIG. 3 (PRIOR ART)
FIG. 3 is a partial schematic diagram of the ballast of FIG. 1 as known in the prior art.
Figure 4:
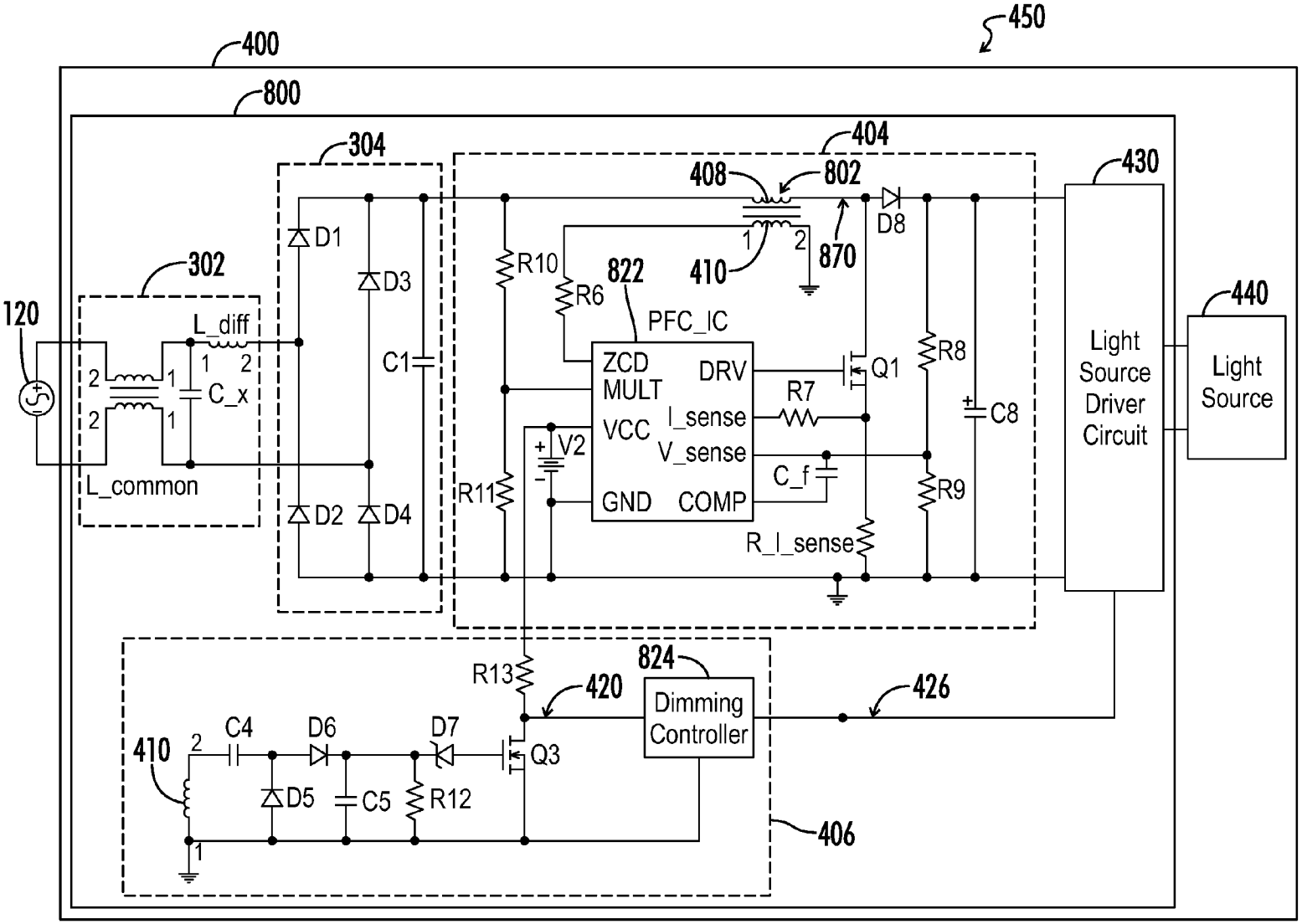
FIG. 4 is a partial schematic and block diagram of an embodiment of a ballast according to the present invention. including a dimming sensor for indirect line voltage conduction angle sensing.

Referring to FIG. 4, a light fixture 450 includes a light source 440, a ballast 800, and a housing 400. The light fixture 450 receives power from an AC power source modified by chopper dimmer (i.e., modified line voltage 120) and outputs light. The light source 440 provides light in response to receiving power from the ballast 800. A housing is connected to (i.e., physically supports and/or electrically connects) the light source 440 and the ballast 800. In some embodiments, the EMI filter 302, rectifier 304, dimming sensor 406, and DC to DC converter 404 may be physically separate (e.g., in a separate case) from the light source driver circuit 430.

The ballast 800 provides power to the light source 440 from the modified voltage 120. The ballast 800 includes an electromagnetic interference (EMI) filter 302, a rectifier 304, a DC to DC converter 404, a dimming sensor 406, and a light source driver circuit 430. The EMI filter 302 minimizes noise propagation between the ballast 800 and the modified voltage 120, as well as noise emissions from the light fixture 450. The rectifier 304 connects to the AC power source 102 via the EMI filter 302 and the chopper dimmer 110. The rectifier 304 receives power from the AC power source 102 and provides rectified power. The DC to DC converter 404 includes a boost inductor 802 having a primary winding 408 and a detection winding 410. The DC to DC converter 404 receives the rectified power from the rectifier 304 and provides a DC power rail having a DC voltage. The dimming sensor 406 monitors a voltage of the detection winding 410 of the boost inductor 802 and provides a dimming signal 420 as a function of the monitored voltage.

In one embodiment, the light source driver circuit 430 is an H-bridge inverter controlled by a pulse width modulation (PWM) controller. The light source driver circuit 430 receives the dimming signal 420 from the dimming sensor 406, receives the DC power rail voltage from the DC to DC converter 404, and provides power from the DC power rail to the light source 440 as a function of the dimming signal 420. An amount of power provided to the light source 440 from the DC power rail by the light source driver circuit 430 corresponds to a dimming level (e.g., a percentage of rated output input by a user via the chopper dimmer 110) indicated by the dimming signal 420.

In one embodiment, the DC to DC converter 404 is a power factor correcting DC to DC converter including a power switch Q1, an output diode D8, an output capacitor C8 and a power factor correction controller 822. The power switch Q1 selectively draws current through the primary winding 408 of the boost inductor 802. The output diode D8 is connected to the primary winding 408 of the boost inductor 802 and is operable to output the DC power rail voltage from the primary winding 408 of the boost inductor 802. The output capacitor C8 is connected between a cathode of the output diode D8 and a circuit ground. The output capacitor C8 stabilizes the DC power rail voltage output by the output diode D8. The power factor correction controller 822 is connected to the detection winding 410 of the boost inductor 802 and the cathode of the output diode D8. The power factor correction controller 822 controls the power switch Q1 as a function of a voltage of the DC power rail and a voltage of the detection winding 410 to maintain the DC power rail at a predetermined voltage and minimize a phase angle between a voltage of the AC power source 102 and a current of the AC power source 102.

In one embodiment of the dimming sensor 406, a first terminal of the detection winding 410 of the boost inductor 802 is connected to circuit ground. The DC to DC converter 404 also includes a voltage regulator operable to provide a bias voltage VCC. In the embodiment shown in FIG. 4, the voltage regulator is integral to the power factor correction controller 822. The dimming sensor 406 includes an input capacitor C4, and input diode D6, and a switch Q3. The input capacitor C4 has a first terminal connected to a second terminal of the detection winding 410 of the boost inductor 802. The input diode D6 has an anode connected to a second terminal of the input capacitor C4. The switch Q3 has an input (e.g., a gate terminal) connected to a cathode of the input diode D6, a low side connected to the circuit ground, and a high side connected to the voltage regulator (i.e., the power factor correction controller 822) to receive the bias voltage VCC. The switch Q3 may be a MOSFET, BJT, or any other switching device. The high side of the switch Q3 is connected to the bias voltage VCC via a resistor R13. Additional circuitry may be included to improve the response of the dimming sensor 406. For example, a zener diode D7 having a cathode connected to the cathode of the input diode D6 and an anode connected to the input of the switch Q3 improves the sensitivity of the gate drive threshold voltage of the switch Q3, decreasing the transition time of the switch Q3. A capacitor C5 and a resistor R12 may be connected in parallel between the cathode of the zener diode D7 and the circuit ground. The dimming sensor 406 may also include a second diode D5 having a cathode connected to the anode of the input diode D6 and an anode connected to the circuit ground. In one embodiment, the input capacitor C4, second diode D5, input diode D6, and capacitor C5 form a charge pump circuit. The resistor R12 discharges the capacitor C5 whenever the voltage across the boost inductor 802 is zero volts. In one embodiment, the dimming sensor 406 includes a charge pump circuit driven by the detection winding 410 of the boost inductor 802 which controls the switch Q3. In one embodiment, the light fixture 450 includes the chopper dimmer 110.

Figure 5:
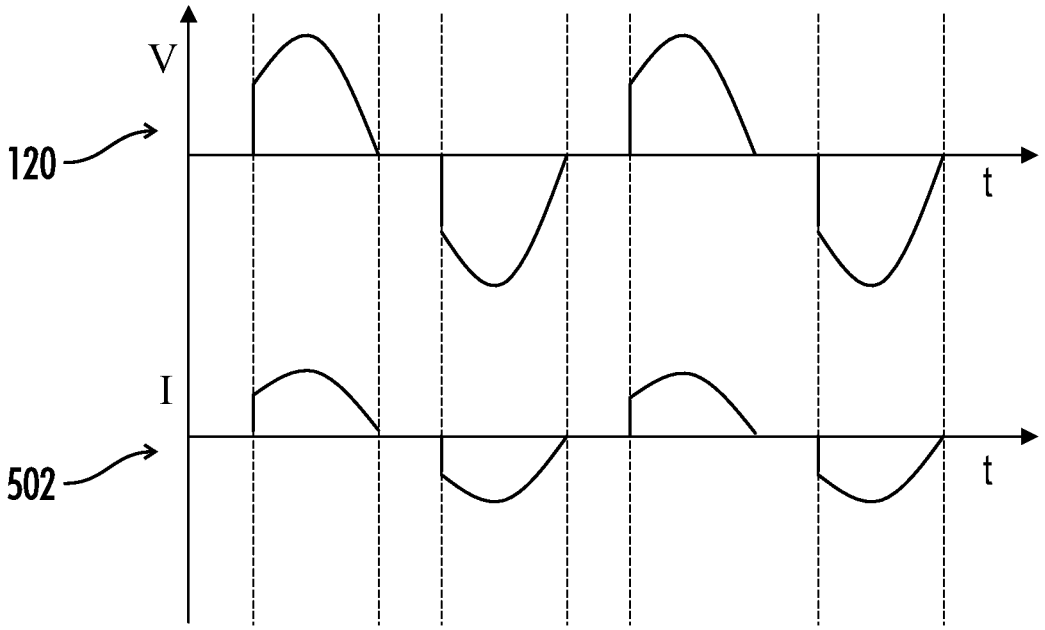
FIG. 5 is a timing diagram showing the line voltage and current of the power factor corrected ballast of FIG. 4.

Referring to FIG. 5, the modified line voltage 120 is shown in a timing diagram with a current 502 drawn by the ballast 800. Because the ballast 800 includes power factor correction, the current 502 aligns in time with the modified line voltage 120. That is, during the OFF time 204 of the modified line voltage 120, the current 502 is zero, and during an ON time 206 of the modified line voltage 120, the current 502 increases and decreases with the modified line voltage 120 (i.e., with the line voltage 202 at the AC power source 102).

Figure 6:
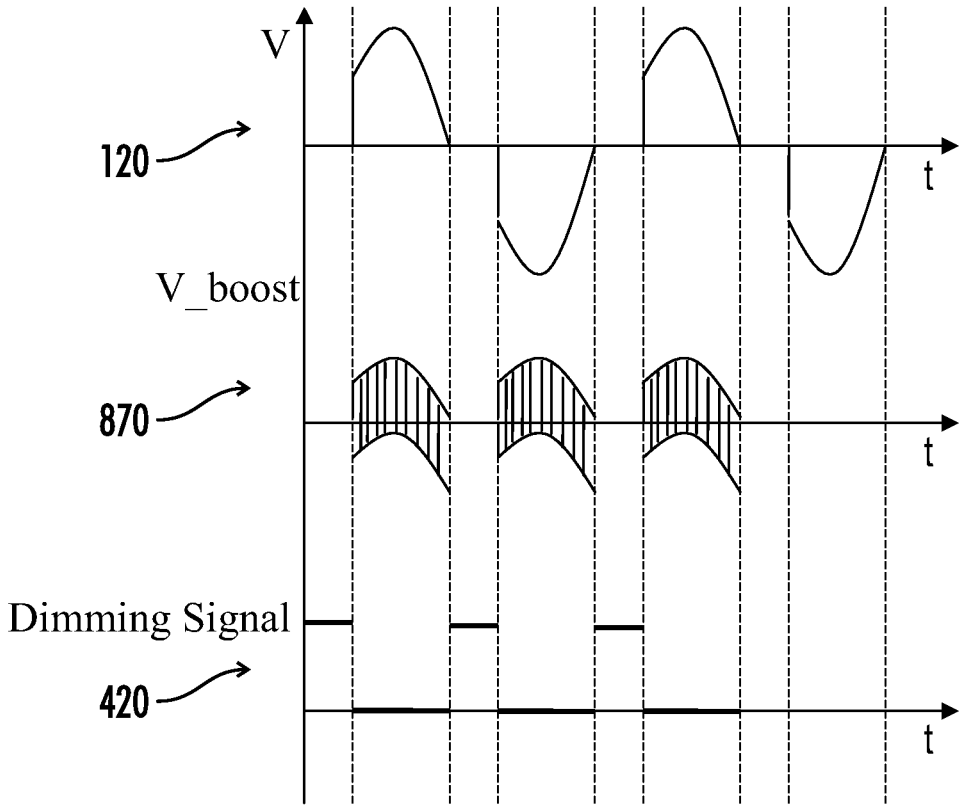
FIG. 6 is a timing diagram showing the voltage, boost inductor voltage, and dimming signal voltage according to one embodiment of the ballast and dimming signal of FIG. 4.

Referring to FIG. 6, a timing diagram shows the modified line voltage 120, the dimming signal 420, and a boost voltage 870. The boost voltage 870 is the voltage at the anode of the output diode D8. The boost voltage 870 is zero during the OFF time 204. The boost voltage 870 is a high frequency pulse train having a peak to peak voltage of the DC rail voltage during the ON time 206. The dimming signal 420 is switched from a first, high level during the OFF time 204 of the modified line voltage 120 to a second, low level during the ON time 206 of the modified line voltage 120. In an alternative embodiment, the high and low switching of the dimming signal 420 is inverted.

In some embodiments, the dimming sensor 406 may include a dimming controller 824 for adapting the dimming signal 420 to a dimming signal 426 compatible with the light source driver circuit 430. The dimming signal 420 and the adapted dimming signal 426 both indicate the same dimming level. The dimming sensor 406 outputs the adapted dimming signal 426 to the light source driver circuit 430 as the dimming signal 420. In one embodiment, the dimming controller 824 is a buffer that provides the dimming signal 420 to the light source driver circuit 430 without alteration.

In one embodiment, the dimming controller 824 converts the dimming signal 420 to a fixed frequency 1 kHz signal having a duty cycle indicating an equivalent dimming level. In another embodiment, the dimming controller 824 converts the dimming signal 420 to a square wave signal that varies from 300 Hz to 1 kHz wherein the frequency indicates an equivalent dimming level. In another embodiment, the dimming controller 824 converts the dimming signal 420 to a digital number indicating the dimming level. These adaptations or conversions of the dimming signal 420 by the dimming controller 824 make the dimming sensor 406 compatible with a number of dimming control schemes implemented by disparate light source driver circuits.

Figure 7:
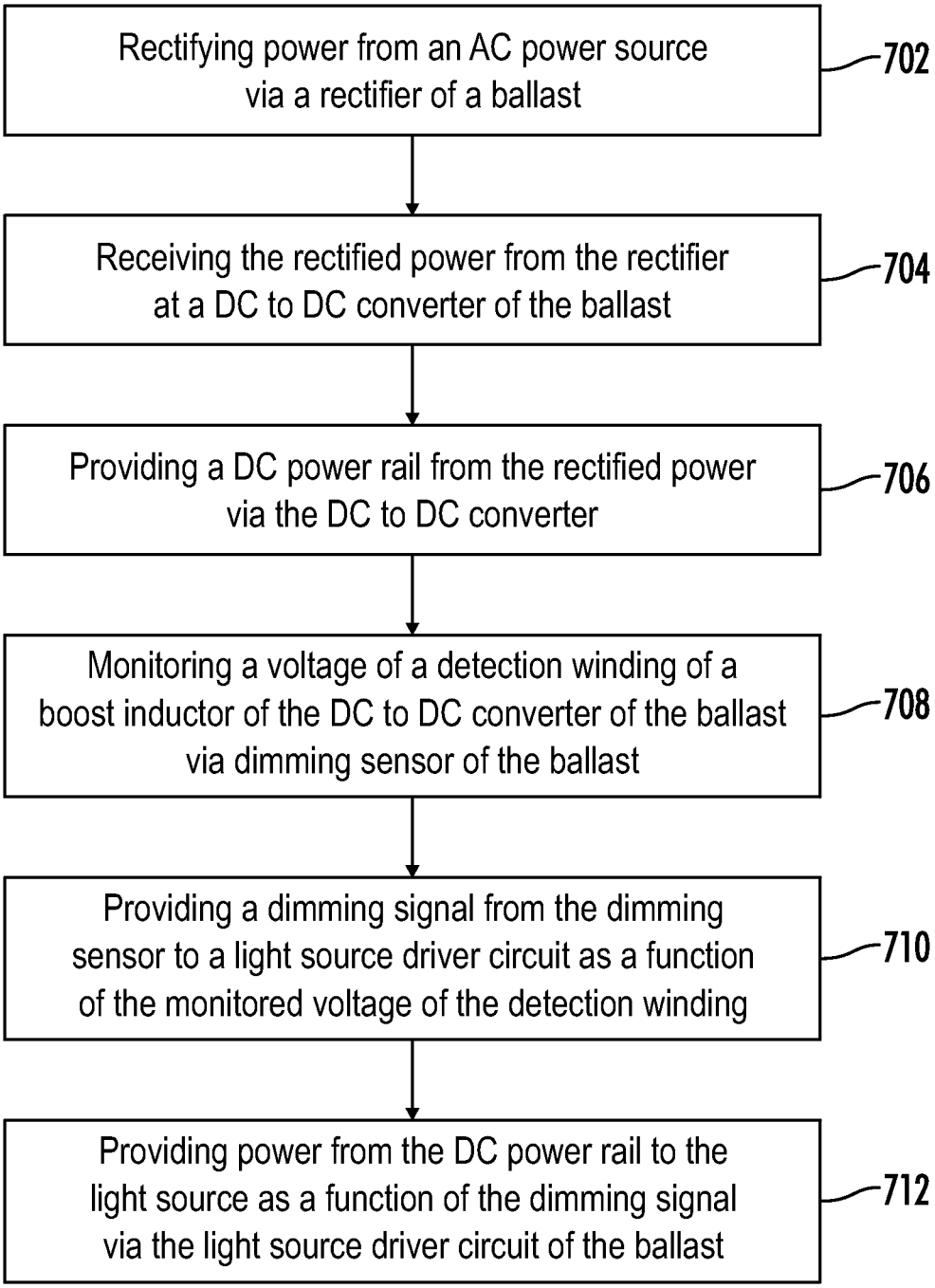
FIG. 7 is a flow chart of a method of providing power to a light source from an AC power source via a ballast wherein the power from the AC power source is modified by a chopper dimmer.

Referring to FIG. 7, a method of providing power to a light source from an AC power source via a ballast, wherein the power from the AC power source is modified by a chopper dimmer is shown. At 702, the ballast rectifies the power received from the AC power source. At 704, a DC to DC converter of the ballast receives the rectified power from the rectifier. The DC to DC converter provides a DC power rail from the rectified power at 706. At 708, a dimming sensor of the ballast monitors a voltage of a detection winding of a boost inductor of the DC to DC converter of the ballast. The dimming sensor signal provides a dimming signal to a light source driver circuit of the ballast as a function of the monitored voltage of the detection winding at 710. At 712, the light source driver circuit provides power from the DC power rail to the light source as a function of the diming signal.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, circuits, and controllers described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. Although embodiments of the present invention have been described in detail, it will be understood by those skilled in the art that various modifications can be made therein without departing from the spirit and scope of the invention as set forth in the appended claims.

A controller, computing device, or computer, such as described herein, includes at least one or more processors or processing units and a system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as hard coding, computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful indirect Line Voltage Conduction Angle Sensing for A Chopper Dimmed Ballast it is not intended that such references be construed as limitations upon the scope of this invention except as set forth in the following claims.

What is claimed is:

1. A ballast operable to provide power to a light source from an alternating current (AC) power source modified by a chopper dimmer, the ballast comprising:

a rectifier operable to receive AC power from the AC power source and provide rectified power;

a DC to DC converter comprising a boost inductor having a primary winding and a detection winding, wherein the DC to DC converter is operable to receive the rectified power from the rectifier and provide a DC power rail;

a dimming sensor operable to monitor a voltage of the detection winding of the boost inductor of the DC to DC converter and provide a dimming signal as a function of the monitored voltage;

a light source driver circuit operable to receive the dimming signal from the dimming sensor, receive the DC power rail from the DC to DC converter, and provide power from the DC power rail to the light source as a function of the dimming signal, wherein an amount of power provided to the light source from the DC power rail by the light source driver circuit corresponds to a dimming level indicated by the dimming signal;

wherein a first terminal of the detection winding is connected to a circuit ground;

the DC to DC converter further comprises a voltage regulator operable to provide a bias voltage; and the dimming sensor comprises an input capacitor having a first terminal connected to a second terminal of the detection winding of the boost inductor, an input diode having an anode connected to a second terminal of the input capacitor, and a switch having an input connected to a cathode of the input diode, a low side connected to the circuit ground, and a high side connected to voltage regulator to receive the bias voltage.

2. The ballast of claim 1, wherein the DC to DC converter further comprises:

a power switch operable to selectively draw current through the primary winding of the boost inductor;

an output diode connected to the primary winding of the boost inductor, wherein the output diode is configured to output the DC power rail from the primary winding of the boost inductor;

an output capacitor connected between a cathode of the output diode and a circuit ground, wherein the output capacitor is effective to stabilize the DC power rail output by the output diode; and a power factor correction controller connected to the detection winding of the boost inductor and the cathode of the output diode, wherein the power factor correction controller is operable to control the power switch as a function of a voltage of the DC power rail and a voltage of the detection winding to maintain the DC power rail at a predetermined voltage and minimize a phase angle between a voltage of the AC power source and a current of the AC power source.

3. The ballast of claim 1, wherein the dimming signal is a pulse width modulated signal having a fixed frequency and a duty cycle that varies as a function of an OFF time of the monitored voltage of the detection winding.

4. The ballast of claim 1, wherein the dimming signal is a square wave signal that varies from 300 Hz to 1 kHz as a function of an OFF time of the monitored voltage of the detection winding.

5. The ballast of claim 1, wherein the dimming signal is a square wave signal that having a time at a first level equal to an ON time of the monitored voltage and a time at a second level equal to an OFF time of the monitored voltage.

6. The ballast of claim 1, wherein the light source driver circuit comprises an electronic ballast, and the light source comprises at least one of a solid state light-emitting element, a fluorescent lamp, or a high intensity discharge lamp.

7. The ballast of claim 1, wherein the chopper dimmer comprises one of a TRIAC dimmer, a DIAC dimmer, or an IGBT dimmer.

8. A light fixture functional to receive power from an alternating current (AC) power source modified by a chopper dimmer and provide light, said light fixture comprising:

a light source effective to provide light in response to receiving power;

a ballast operable to provide power to the light source from the AC power source modified by the chopper dimmer, the ballast comprising a rectifier operable to connect to the AC power source, receive AC power from the AC power source, and provide rectified power, a DC to DC converter comprising a boost inductor having a primary winding and a detection winding, wherein the DC to DC converter is operable to receive the rectified power from the rectifier and provide a DC power rail, a dimming sensor operable to monitor a voltage of the detection winding of the boost inductor of the DC to DC converter and provide a dimming signal as a function of the monitored voltage, and a light source driver circuit operable to receive the dimming signal from the dimming sensor, receive the DC power rail from the DC to DC converter, and provide power from the DC power rail to the light source as a function of the dimming signal, wherein an amount of power provided to the light source from the DC power rail by the light source driver circuit corresponds to a dimming level indicated by the dimming signal; and a housing connected to the light source and the ballast;

wherein a first terminal of the detection winding is connected to a circuit ground;

the DC to DC converter further comprises a voltage regulator operable to provide a bias voltage; and the dimming sensor comprises an input capacitor having a first terminal connected to a second terminal of the detection winding of the boost inductor, an input diode having an anode connected to a second terminal of the input capacitor, and a switch having an input connected to a cathode of the input diode, a low side connected to the circuit ground, and a high side connected to voltage regulator to receive the bias voltage.

9. The light fixture of claim 8, wherein the DC to DC converter further comprises:

a power switch operable to selectively draw current through the primary winding of the boost inductor;

an output diode connected to the primary winding of the boost inductor, wherein the output diode is operable to output the DC power rail from the primary winding of the boost inductor;

an output capacitor connected between a cathode of the output diode and a circuit ground, wherein the output capacitor is operable to stabilize the DC power rail output by the output diode; and a power factor correction controller connected to the detection winding of the boost inductor and the cathode of the output diode, wherein the power factor correction controller is operable to control the power switch as a function of a voltage of the DC power rail and a voltage of the detection winding to maintain the DC power rail at a predetermined voltage and minimize a phase angle between a voltage of the AC power source and a current of the AC power source.

10. The light fixture of claim 8, wherein the dimming signal is a pulse width modulated signal having a fixed frequency and a duty cycle that varies as a function of an OFF time of the monitored voltage of the detection winding.

11. The light fixture of claim 8, wherein the dimming signal is a square wave signal that varies from 300 Hz to 1 kHz as a function of an OFF time of the monitored voltage of the detection winding.

12. The light fixture of claim 8, wherein the dimming signal is a square wave signal that having a time at a first level equal to an ON time of the monitored voltage and a time at a second level equal to an OFF time of the monitored voltage.

13. The light fixture of claim 8, wherein the light source driver circuit comprises an electronic ballast and the light source comprises at least one of a solid state light-emitting element, a fluorescent lamp, or a high intensity discharge lamp.

14. The light fixture of claim 8, wherein the chopper dimmer comprises one of a TRIAC dimmer, a DIAC dimmer, or an IGBT dimmer.

* * * * *